US005253523A

United States Patent [19]

Bernardin

[11] Patent Number: 5,253,523

[45] Date of Patent: Oct. 19, 1993

[54] ABSORPTION TYPE CHILLER

[76] Inventor: Billy J. Bernardin, 218 Iowa St., Wilton, Iowa 52778

[21] Appl. No.: 878,700

[22] Filed: May 5, 1992

[51] Int. Cl.[5] ..... F25B 15/00

[52] U.S. Cl. ..... 62/476; 62/483; 62/475

[58] Field of Search ..... 62/476, 475, 483, 101

[56] References Cited

U.S. PATENT DOCUMENTS

| | | | |
|---|---|---|---|
| 3,126,720 | 3/1964 | Stubblefield | 62/476 |
| 3,616,375 | 10/1971 | Inoue | 204/162 R |
| 3,626,711 | 12/1971 | Porter et al. | 62/476 |
| 3,721,109 | 3/1973 | Porter | 62/476 |
| 4,090,372 | 5/1978 | Lamb | 62/141 |
| 4,223,539 | 9/1980 | Webb et al. | 62/476 |
| 4,440,001 | 4/1984 | Vardi et al. | 62/475 |
| 4,460,555 | 7/1984 | Thompson | 423/309 |
| 4,470,272 | 9/1984 | Itoh et al. | 62/474 |
| 4,484,453 | 11/1984 | Niess | 62/195 |
| 4,554,792 | 11/1985 | Margulefsky et al. | 62/77 |
| 4,650,587 | 3/1987 | Polak et al. | 210/638 |
| 4,805,416 | 2/1989 | Manz et al. | 62/292 |
| 4,842,812 | 6/1989 | Panson et al. | 376/306 |

FOREIGN PATENT DOCUMENTS

| | | | |
|---|---|---|---|
| 1-312368 | 12/1989 | Japan | 62/476 |

OTHER PUBLICATIONS

Form 795-07261—2 sheets; Graymills Superflo Filters; Chicago, Illinois (not dated).

Instructions and Repair parts for TE7-MD-HC, and EP-7-MD-HC—2 sheets; Little Giant Pump Col; Oklahoma City, Oklahoma (not dated).

Catalogue Form #2733-383LP; pp. 4-6—2 sheets; PV Series Piston Vibrators; Thumper® Series Pneumatic Impactors Piston Vibrator Mounting Information; Martin Engineering, Neoponsit, Illinois (not dated).

Literature File No. ABS-M-2 Oper.-Main; Trane Refrigeration Products; Water Chillers-Absorption; La Cross, Wisconsin,; Nov. 1971 pp. 1-36.

Schematic of Absorption Cycle; FIG. 2, p. 3 (not dated or otherwise identified).

*Primary Examiner*—Albert J. Makay
*Assistant Examiner*—William C. Doerrler
*Attorney, Agent, or Firm*—Henderson & Sturm

[57] ABSTRACT

An absorption type chiller is improved as to operation and efficiency by the addition thereto of a pair of liquid-transfer units, one between the concentrated salt solution circuit and the intermediate salt solution circuit and including a magnetic filter and a pump additional to and independent of the system pumps. The purpose of this unit is to filter off iron oxide (rust) that accumulates periodically in the typical system. In addition to this unit, the heat exchanger in the concentrated solution line is vibrated in order to loosen and free the iron oxide particles. A second liquid-transfer unit is connected between the dilute solution line and the refrigerant line and includes an ammonia scavenger canister or its equivalent.

17 Claims, 1 Drawing Sheet

ABSORPTION TYPE CHILLER

BACKGROUND AND SUMMARY OF THE INVENTION

During the operating life of an absorption chiller, any introduction of air into the system will result in oxidation of the metal surfaces and this in turn leads to further depletion of the corrosion inhibitors in the aqueous salt solution, and ultimately the rust scale (iron oxide) will dislodge and find its way into the shell side of the heat exchanger and be introduced to the spray nozzle lines, plugging the nozzles.

Present service procedures require periodic shutdowns of the system for cleaning, which involves disconnections, partial dismantling, etc., all increasing the chances of air entering the system. The present invention overcomes these obstacles by the provision of means for automatically filtering the aqueous salt solution, particularly in systems using lithium bromide. This can be achieved without adversely effecting the operation of the chiller or requiring complicated and costly changes in the system. Accordingly it is a principal object of the invention to introduce a liquid-transfer unit including a magnetic filter and associated pump between the concentrated salt solution line and the intermediate solution line (or less concentrated solution line), the purpose being to filter out rust particles from the circuit. To augment this process, a pneumatic vibrator or the like is added to the heat exchanger upstream of the magnetic filter unit in order to increase the rust-removing function of that unit.

A further object is to provide a scavenging unit between the refrigerant line and the diluted salt solution line and the refrigerant line for the purpose of removing excess ammonia In the case of each of the liquid-transfer units (magnetic and scavenging), a pump is utilized in addition to and independently of the typical system pumps.

Features and advantages of the invention, additional to those just outlined, will appear as a preferred embodiment of the invention is disclosed in the detail in the ensuing description in conjunction with the accompanying drawings.

DETAILED DESCRIPTION OF A PREFERRED EMBODIMENT OF THE INVENTION

Figure 1:
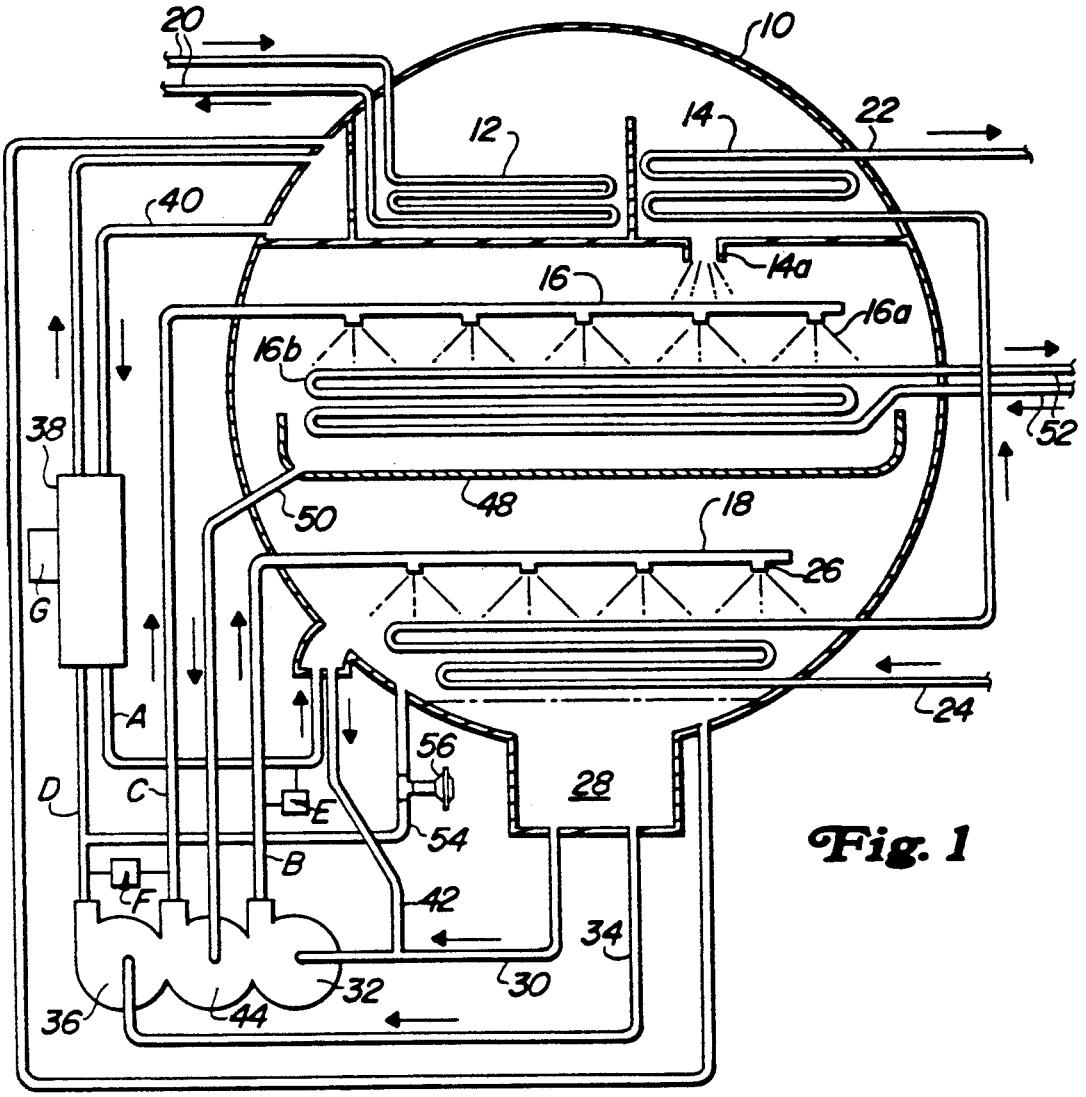
FIG. 1 is a schematic view of a known chiller, with the improvements indicated diagrammatically as to location.

Familiarity of those skilled in the art with the representative chiller depicted in FIG. 1 will be assumed and thus the description will be somewhat curtailed except where necessary to clarify the relationship of the inventive additions. The FIG. 1 system includes a shell 10 within which are housed a concentrator 12, condenser 14, evaporator 16 and absorber 18. Steam or hot water lines are shown at 20 leading to and from the concentrator and a cooling water line 22 exits from the condenser. Cooling water coils 24 lead into the shell below the absorber 18, which typically has spray nozzles 26. From the accumulation of dilute salt solution at 28 at the bottom of the shell, a line 30 leads to a pump 32 having an outlet line B leading to the absorber 18, which is typical. A second dilute solution line 34 goes to the inlet side of a system pump 36 whose outlet extends as a line D through a heat exchanger 38 to the concentrator. A return line 40 from the concentrator runs to the heat exchanger and exits therefrom as a line A that continues to the lower part of the shell 10 and thence to the pump 32 via line 42. Also as part of the basic system, a refrigerant line C leads from the outlet side of a third system pump 44 to the evaporator 16 which has spray nozzles 46. The evaporator has a reservoir 48 from which refrigerant is returned via a line 50 to the inlet side of the pump 44. System water coils 52 are included in the evaporator. A further line 54 runs from the shell 10 back to the line D and has an on/off valve 56. The system may include additional valves for usual purposes but these are omitted in the interests of brevity.

The absorption cold generator or chiller disclosed here comprises four basic sections: concentrator 12, condenser 14, evaporator 16 and absorber 18. The evaporator and absorber form the low pressure side of the system and the concentrator and condenser the high pressure side. The pressure in the high side is roughly ten times greater than in the low side. The refrigeration cycle begins in the evaporator 16 with the evaporation of liquid refrigerant, the same as in conventional air conditioning systems. Liquid refrigerant at relatively high pressure passes through an orifice **14*a* in the condenser 14 to the low pressure region of the evaporator 16**. As the pressure of the refrigerant falls, a portion flashes to a vapor, causing the temperature of the remaining liquid refrigerant to drop. The flashing continues until the refrigerant cools to the saturation temperature corresponding to the comparatively low pressure in the evaporator. The passage of refrigerant through the condenser orifice can be compared with the passage of refrigerant through the expansion valve of a conventional system.

The cool refrigerant, at approximately 40 F., flows by gravity to the refrigerant storage area. It is pumped from there to the evaporator spray nozzles **16*a* and sprayed over the evaporator tube bundle 16*b***. As the refrigerant drops onto the tube bundle containing the warmer system water, the refrigerant begins to evaporate. Heat for vaporization comes from the system water. The cooling effect thus obtained lowers system water approximately 10 F. in a typical system.

The refrigerant, now a vapor, passes to the absorber 18 where the pressure is the lowest in the system. In the absorber, the refrigerant vapor is absorbed by a concentrated salt solution in line A. This absorption process causes the salt solution to become diluted. The diluted salt solution is pumped via pump 36, to the concentrator 12 where the temperature and pressure are the highest in the system. In the concentrator, heat at 20 is applied to the salt solution, causing the refrigerant to be boiled off. While the refrigerant is a vapor at low pressure when in the absorber and evaporator, it is a vapor at high pressure after being boiled off in the concentrator. Hence, the primary purpose of absorbing the refrigerant vapor in the absorber and then changing it back to a vapor in the concentrator is to raise its pressure. The absorption process accomplishes the same thing as the compressor in a conventional system. The low pressure vapor, by being absorbed in the salt solution, can be pumped to the high pressure region of the concentrator.

The high pressure refrigerant vapor passes into the condenser, releases its heat of vaporization to cooling water flowing through a typical tube bundle and falls as a liquid to the bottom of the condenser. The cycle continues as the high pressure liquid refrigerant is forced through the orifice to the evaporator.

The refrigerant in the disclosed system is water, which makes a good refrigerant for air conditioning applications because of the high refrigerating effect produced when evaporated at approximately 40 F. The salt solution mentioned before is lithium bromide in water. A lithium bromide solution is used as the absorbent because of its affinity, or physical attraction, for water. And beyond that, it releases the refrigerant water as a vapor at a fairly low temperature.

To improve the economy of the system, a heat exchanger 38 is added between the absorber and concentrator. The cool diluted absorbent from the absorber passes through the heat exchanger in one direction and hot concentrated absorbent passes through a separate part of the heat exchanger in the opposite direction. The resulting exchange of heat is beneficial to both solutions. The diluted absorbent takes on heat and therefore requires less heat in the concentrator to reach its boiling point. On the other hand, the intermediate solution resulting from the mixing of concentrated and diluted solutions requires less cooling water in the absorber to lower its temperature and vapor pressure to increase its absorbing qualities.

Consider a closed tank partially full of 50% lithium bromide solution (50% salt and 50% water by weight) at a temperature of 110 F. Under these conditions, there are molecules of water vapor actually escaping from the solution. However, the exact same number of water vapor molecules are being reabsorbed into the solution. As long as this balance exists, the solution is in equilibrium.

One aspect of the invention resides in the affixation of a vibrator G to the heat exchanger 38 for the purposes of aiding in the dislodging of rust scale. The vibrator may be of any well-known type, preferably pneumatic, a variety of models of which are available on the current market.

Figure 2:
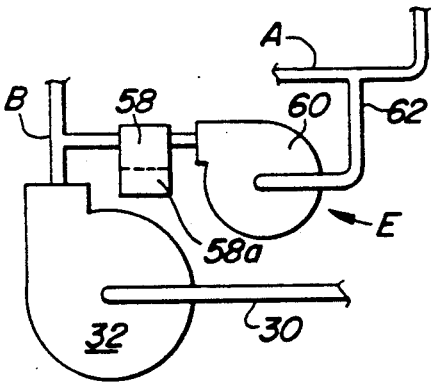
FIG. 2 is an enlarged fragmentary view of a representative unit including a magnetic filter and pump means.

Another phase of the invention is the provision of a liquid-transfer means or unit E interconnecting the lines A and B and shown in greater detail in FIG. 2. This unit includes a magnetic filter 58 and associated pump 60 which is additional to and independently of the system pumps 32, 36 and 44. The pump may be of any type currently commercially available and, given the system characteristics, may be a centrifugal model capable of delivering approximately fifty gallons per minute at twenty-five psi. The magnetic screen or filter should preferably handle at least ten times the resultant pump flow in order to minimize turbulence and rust retention. The filter may also include a string filter adjunct (not shown) to enable operation of the system while the filter screen is cleaned. As seen, the suction side of the pump 60 is connected at 62 to the concentrated solution line A downstream of the heat exchanger 38 and the pump output goes through the filter 58 to a lesser concentrated solution line, here the intermediate solution line B upstream of the system pump 32 a sediment collector 58*a* may be provided for the magnetic filter to enable at least temporary operation of the system while the magnetic filter is being cleaned. Alternately, the outlet of the filter 58 could lead to the dilute solution line D. The vibrator G will be of such nature as to provide light knocks on the heat exchanger. When conditions indicate that the filter is plugging, the pump 60 can be shut down, by any suitable manual, etc., controls (not shown), suitable valves closed, etc. and the filter rinsed and replaced. At present, it is found that filter screens of sixty, one-hundred and one-hundred and fifty mesh work satisfactorily.

Figure 3:
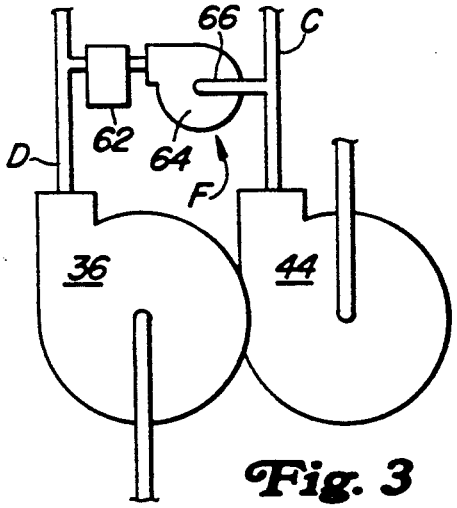
FIG. 3 is a similar view showing a pump-canister unit serving the ammonia-scavenging function.

A third improvement in the system is the provision of a liquid-transfer means or unit F between the refrigerant solution line C and the dilute solution line D. See FIG. 3. An ammonia scavenger canister 62 is connected to the output side of a pump 64 that has its inlet connected at 66 to the refrigerant line C upstream of the outlet of the system pump 44, with the canister outlet leading to the dilute solution line D upstream of the system pump 36. Preferably, the canister 62 is of the carbon filter type operative to remove ammonia from the refrigerant.

The entire system benefits from the use of the inventive units. The pump 60 facilitates proper flow from the body side of the heat exchanger to the absorber sprays, thus enabling filtering during operation with no derating of capacity. The vibration of the heat exchanger is found to be effective through transmission to the entire chiller to dislodge scale from the absorber nozzles. It is no longer necessary to open up the system, draining, etc. and flushing and mechanically cleaning the spray nozzles. The scavenger unit F eliminates or at least minimizes tubing or line deterioration because of ammonia. When the scavenger material is a desiccant, it should be quite free of large amounts of scale. Varying results will be obtained according to changes in magnetic screen size, surface area, etc., much of which is dependent on overall sizes, etc., of the entire system. The nature of the improved solutions can be best observed through transparent tubing. One type of scavenger found effective is known as chloramine or "Ammo Chips," a trademark of Aquarium Pharmaceuticals, Chalfont, Pa. 18914. Uses of equivalent products is not excluded, and it will be clear that variations in improvement, combinations, etc., may be resorted to without departure from the spirit and scope of the invention.

I claim:

1. In an absorption type chiller system including a concentrator, a condenser, an evaporator, an absorber and system circuits comprising a concentrated aqueous salt solution circuit, a less concentrated aqueous salt solution circuit and a refrigerant circuit, the improvement comprising a liquid-transfer means from the concentrated salt solution circuit to a less concentrated salt solution circuit, said liquid transfer means comprising a connection including a magnetic filter for filtering out iron oxide from the concentrated salt solution.

2. In the system according to claim 1, in which the liquid-transfer means comprises a liquid solution pump for moving the concentrated aqueous salt solution through the magnetic filter.

3. In a system according to claim 1, wherein the system circuits comprise system pumps for circulating aqueous salt solutions and the refrigerant, and the liquid transfer means comprises a liquid transfer pump that is additional to and independent of the system pumps.

4. In a system according to claim 1, including a sediment collector for the magnetic filter enabling at least temporary operation of the system while the magnetic filter is being cleaned.

5. In a system according to claim 1, in which the system comprises a heat exchanger in the concentrated aqueous salt solution circuit, and the liquid-transfer means is connected between the heat exchanger and a less concentrated aqueous salt solution circuit.

6. In a system according to claim 5, including a vibrator attached to and for vibrating the heat exchanger.

7. In a system according to claim 6, in which the heat exchanger is upstream of the liquid-transfer means.

8. In a system according to claim 1, further comprising an ammonia scavenger means connected across a less concentrated aqueous salt solution circuit and the refrigerant circuit.

9. In a system according to claim 8, in which the ammonia scavenger means is of the carbon based type.

10. In a system according to claim 8, further comprising an ammonia scavenger pump for moving the refrigerant through the ammonia scavenger means.

11. In a system according to claim 1, further comprising a vibrator means acting on and for vibrating the concentrated aqueous salt solution circuit upstream of the liquid-transfer means.

12. In a system according to claim 11, further comprising ammonia scavenger means connected between a less concentrated salt solution circuit and the refrigerant circuit.

13. In an absorption type chiller system including a concentrator, a condenser, an evaporator, an absorber and circuits for circulating aqueous salt solutions comprising a concentrated aqueous salt solution circuit and a less concentrated aqueous salt solution circuit, and a refrigerant circuit, the improvement comprising a liquid-transfer means from the refrigerant circuit to a less concentrated aqueous salt solution circuit.

14. In a system according to claim 13, further comprising system pumps for the circuits, and wherein the liquid-transfer means comprises a liquid transfer pump that is additional to and independent of the system pumps for the circuits.

15. In an absorption type chiller system including a concentrator, a condenser, an evaporator, an absorber and circuits for circulating aqueous salt solutions comprising a concentrated aqueous salt solution circuit and a refrigerant circuit, the improvement comprising a heat exchanger associated with the concentrated aqueous salt solution circuit and a vibrator means acting on the heat exchanger of the concentrated aqueous salt solution circuit.

16. In an absorption type chiller system including a concentrator, a condenser, an evaporator, an absorber and system circuits comprising circuits for circulating aqueous salt solutions comprising a concentrated salt solution circuit and a less concentrated salt solution circuit, and a refrigerant circuit, the improvement comprising a liquid-transfer means from the concentrated aqueous salt solution circuit to a less concentrated aqueous salt solution circuit, said liquid transfer means comprising a connection comprising a magnetic filter for filtering out iron oxide from the concentrated aqueous salt solution, an ammonia scavenger means connected between a less concentrated aqueous salt solution circuit and the refrigerant circuit, and vibrator means acting on the concentrated aqueous salt solution circuit.

17. In a system according to claim 16, in which the system circuits comprise circuit pumps, the liquid transfer means comprises a liquid transfer pump, and the ammonia scavenger means comprises an ammonia scavenger pump, said liquid transfer pump and said ammonia scavenger pump being additional to and independent of the circuit pumps.

* * * * *